US006700571B2

(12) United States Patent
Nakatani et al.

(10) Patent No.: US 6,700,571 B2
(45) Date of Patent: Mar. 2, 2004

(54) MATRIX-TYPE DISPLAY DEVICE

(75) Inventors: Hidehiko Nakatani, Tokyo (JP); Kazuhiro Sugiyama, Tokyo (JP)

(73) Assignee: Mitsubishi Denki Kabushiki Kaisha, Tokyo (JP)

( * ) Notice: Subject to any disclaimer, the term of this patent is extended or adjusted under 35 U.S.C. 154(b) by 104 days.

(21) Appl. No.: 09/962,166

(22) Filed: Sep. 26, 2001

(65) Prior Publication Data

US 2002/0041277 A1 Apr. 11, 2002

(30) Foreign Application Priority Data

Sep. 27, 2000 (JP) ..... 2000/293760

(51) Int. Cl.[7] ..... G09G 5/00
(52) U.S. Cl. ..... 345/213; 345/214
(58) Field of Search ..... 345/87, 98, 211, 345/212, 213, 214; 349/62, 113, 141

(56) References Cited

U.S. PATENT DOCUMENTS 5,095,301 A * 3/1992 Guttag et al. ..... 345/605
5,446,496 A 8/1995 Foster et al.
5,576,736 A * 11/1996 Miwa et al. ..... 345/534
5,680,175 A 10/1997 Yanai et al.
5,764,240 A 6/1998 Herz
5,861,879 A 1/1999 Shimizu et al.
6,522,376 B1 * 2/2003 Park et al. ..... 349/113

FOREIGN PATENT DOCUMENTS

EP 0525986 A2 2/1993
JP 6-130910 5/1994
JP 10-301543 11/1998
JP 11-095728 4/1999

* cited by examiner

*Primary Examiner*—Amare Mengistu
(74) *Attorney, Agent, or Firm*—Birch, Stewart, Kolasch & Birch, LLP

(57) ABSTRACT

A matrix-type display device has a matrix display panel, a frame memory, and a graphics memory. Input image data are temporarily buffered in the graphics memory, then transferred to the frame memory and read out to drive the matrix display panel. Readout from the frame memory is cyclic, and is synchronized with a frame synchronization signal. A synchronizing circuit also synchronizes the transfer of data from the graphics memory to the frame memory with the frame synchronization signal, so that each displayed frame is generated from a single frame of image data, and not from parts of two different frames. Moving images can therefore be reproduced faithfully. This matrix-type display device is useful in mobile information-terminal equipment, such as mobile telephone sets.

10 Claims, 11 Drawing Sheets

MATRIX-TYPE DISPLAY DEVICE

BACKGROUND OF THE INVENTION

1. Field of the Invention

The present invention relates to a display device for displaying an image by using a display panel of the matrix type, with picture elements disposed in an array of matrix intersections, such as a matrix-type liquid-crystal panel or a matrix-type electroluminescent display panel; more particularly, it relates to a matrix-type display device for use in mobile information-terminal equipment, such as a mobile telephone set, that displays moving images.

2. Description of Related Art

Display devices employing matrix-type liquid crystals and the like have hitherto been used in portable information-processing equipment such as mobile telephone sets and mobile information-terminal equipment.

A basic requirement of recent mobile telephones, for example, is a battery-driven operating time of several hundred hours in the state in which a so-called standby screen is displayed. In the matrix-type display devices used in mobile telephones, therefore, a frame memory, separate from the graphics memory that has the role of input buffering of image data, is often built into the circuit for driving the liquid-crystal display panel, to reduce power consumption by making image data transfer unnecessary when a still image is displayed. That is, when a still image is displayed, these devices do not consume power by transferring data to the circuit for driving the liquid-crystal display panel; large numbers of lower-power liquid-crystal matrix-type display devices configured in this way have been used in mobile telephones in recent years.

Low-cost STN (super-twisted birefringent) liquid-crystal panels with built-in frame memories as described above, which are still lower in power consumption, have frequently been used as liquid-crystal display panels for mobile telephones. However, a videophone function is expected to be added in the future, together with the start of moving-picture distribution service conforming to the IMT-2000 standard. A moving-image display will then be necessary, and since the conventional STN liquid-crystal panel has inadequate response speed, a changeover to display panels that support moving-image displays is foreseen for mobile telephones. Specifically, it is foreseen that active-matrix liquid-crystal panels such as TFT (Thin Film Transistor) liquid-crystal panels and MIM (Metal Insulator Metal) liquid-crystal panels, which have a high response speed and good image quality, will be primarily used.

The active-matrix liquid-crystal panels that are expected to be used in the future are not, in general, as low in power consumption as the STN liquid-crystal panels that have been used in the past. Active-matrix liquid-crystal panels with power consumption reduced to a level permitting use in mobile telephones have been developed in recent years, however.

As for STN liquid-crystal panels, although their future use has become uncertain because of their comparatively slow response speed, fast-response STN liquid-crystal panels with response speeds increased to enable the display of moving images are being developed.

Organic electroluminescent (EL) panels, which employ a display method in which the picture-element section itself is made to emit light, have a much faster response speed than liquid-crystal panels, and since these displays panels are of the self-luminous type, they do not require illumination such as back-lighting or front-lighting, so their power consumption is not very high. Accordingly, organic EL display panels are considered suitable as display panels for mobile telephones because they can be slimmed and lightened by the amount taken up by back-lighting or other illumination.

The general response speeds of the display panels described above are about 300–500 msec for the STN liquid-crystal panels that have been used in mobile telephones, about 30–50 msec for an active-matrix liquid-crystal panel such as a TFT, about 70–80 msec for a fast-response STN liquid-crystal panel, and on the order of several microseconds for an organic EL panel.

FIG. 9 is a block diagram showing the structure of a conventional matrix-type display device with a built-in frame memory.

In the matrix-type display device 9 in FIG. 9, reference numeral 70 denotes an input control section that controls the timing etc. of input image data, and reference numeral 80 denotes a display-panel module that displays the input image data.

The input control section 70 has a graphics memory 11 that can temporarily store input image data at least in frame units, a data-write control circuit 12 comprising a microprocessor or the like with an address bus, a data bus, control signal lines, and the like, that carries out control when the input image data are written in the graphics memory 11, and a data-read control circuit 13 that reads the image data temporarily stored in the graphics memory 11 and transfers the data to the display-panel module 80.

The display-panel module 80 has: a frame memory 21 that can store image data transferred from the input control section 70 in at least frame units; a display panel 22 in which picture-element units are provided at intersections in a matrix formed by a plurality of signal lines laid out in parallel columns and a plurality of signal lines laid out in parallel rows; a signal-electrode driving circuit 23 that generates a clock signal as a reference for displaying an image on the display panel 22 and, based on the clock signal, generates control signals for reading image data from the frame memory 21 and driving the signal lines of the display panel 22, and generates a frame synchronization signal and a line synchronization signal of the display panel 22; and a scan-electrode driving circuit 24 that generates control signals based on the frame synchronization signal and line synchronization signal to drive the scanning lines of the display panel 22. The display panel 22 is, for example, a liquid-crystal display panel with liquid-crystal display elements disposed in a matrix array.

The image data input to the matrix-type display device 9 from the outside and written in the graphics memory 11 are GD1; the image data read from the graphics memory 11 and transferred to the frame memory 21 are GD2; the image data read from the frame memory 21 and input to the signal-electrode driving circuit 23 are GD3. The frame synchronization signal output from the signal-electrode driving circuit 23 to the scan-electrode driving circuit 24 is FS; the line synchronization similarly output from the signal-electrode driving circuit 23 to the scan-electrode driving circuit 24 is LS; the read control signal likewise output from the signal-electrode driving circuit 23 to read the stored contents of the frame memory 21 is RC.

The operation of the matrix-type display device 9 will be described with reference to the image-data transfer timing diagram in FIG. 10, as well as to FIG. 9.

Image data GD1 are input to the input control section 70 of the matrix-type display device 9 from the outside by a communication function or the like and stored temporarily in the graphics memory 11 under control of the data-write control circuit 12. When the process of storing the image data GD1 in the graphics memory 11 ends at timing t1, those image data are immediately read out by the data-read control circuit 13 and transferred to the frame memory 21 as image data GD2, as shown in FIG. 10.

In the display-panel module 80, the image data stored in the frame memory 21 are read out periodically by the signal-electrode driving circuit 23 as image data GD3, in a refresh cycle based on an independently generated clock signal, as shown in FIG. 10, and are input to the signal-electrode driving circuit 23. Using the independent clock, the signal-electrode driving circuit 23 generates the read control signal RC and sends it to the frame memory 21, generates and outputs control signals for the signal electrodes of the matrix display panel 22, and generates a frame synchronization signal FS and line synchronization signal LS and sends them to the scan-electrode driving circuit 24. The scan-electrode driving circuit 24 generates and outputs control signals for the scanning electrodes of the matrix display panel 22, based on the frame synchronization signal FS and line synchronization signal LS.

FIGS. 11A to 11C are drawings showing a thick vertical line moving from the left edge toward the right edge on the matrix display panel 22 of the matrix-type display device 9.

The frame frequency of the display panel 22 is generally about sixty frames per second, several times the frequency of data transfer from the graphics memory 11 to the frame memory 21. The transfer of image data GD2 is carried out asynchronously with respect to the readout of image data GD3 from the frame memory 21 to the matrix display panel 22. If the image data GD3 read from the frame memory 21 for each frame are, in proceeding temporal order, the n-th frame, the (n+1)-th frame, and the (n+2)-th frame, as shown in FIG. 10, then the image of the n-th frame, with the vertical line 100*a*, is first displayed continuously as in FIG. 11A.

Next, at timing t2 in the (n+1)-th frame in FIG. 10, since image data GD2 and GD3 are not synchronized, the writing of image data GD2 overtakes and passes the readout of image data signal GD3. Thus as shown in FIG. 11B, below timing t2 in the vertical scanning direction, the image of vertical line 100*b* in the (n+1)-th frame becomes the image of the newly written vertical line 101*a*, creating a discontinuous offset in the vertical line. This offset disappears in the (n+2)-th frame shown in FIG. 11C, in which there is only the newly written vertical line 10*b*.

Thus in the conventional matrix-type display device 9 shown in FIG. 9, because the image data GD2 are transferred from the graphics memory 11 to the frame memory 21 asynchronously with respect to the frame cycle of the matrix display panel 22, a situation arises in which the image frame displayed on the display panel 22 switches midway through to the image of the next frame.

This type of situation also occurs when the conventional STN liquid-crystal panel, which has a slow response speed, is used as the matrix display panel 22. Compared with the one-frame image data transfer time in the display panel, however, the response time of the liquid crystal in the conventional STN liquid-crystal panel is so long that a problem occurs: even if image data are transferred frame by frame to display a full-motion moving image, the liquid crystal cannot respond in time to produce an adequate display, so even if a vertical offset occurred in an image because the next image was transferred midway through the display of one frame on the liquid-crystal display panel, display of the image had usually already become impossible, so the problem was comparatively unnoticeable and was ignored.

Nevertheless, when a display panel with a comparatively fast response speed, such as an active-matrix liquid-crystal panel, a fast-response STN panel, an organic EL panel or the like is used in a mobile telephone set in order to display moving images as described above, for example, for images with image data moving in the horizontal direction as shown in FIG. 11B, since the problem of response speed has been eliminated, the problem of one frame changing midway through to the next frame and a vertical offset occurring in the image becomes apparent. As a result, the quality of the displayed moving image is markedly degraded. Accordingly, when a display panel with a comparatively fast response speed is used in a mobile telephone or the like, the problem of the occurrence of vertical offsets in the image becomes a problem that cannot be ignored.

SUMMARY OF THE INVENTION

An object of the present invention is to improve the display of moving images in mobile information-terminal equipment.

The invented matrix-type display device has a matrix display panel and a frame memory. A signal-electrode driving circuit generates a frame synchronization signal and a line synchronization signal, and generates control signals for reading the image data from the frame memory and driving the signal lines of the matrix display panel. From the frame synchronization signal and line synchronization signal, a scan-electrode driving circuit generates control signals that drive the scanning electrodes of the matrix display panel. Frames of image data read from the frame memory are thereby displayed on the matrix display panel.

The invented matrix-type display device also has a graphics memory for temporary buffering of input image data, a data-write control circuit that controls the writing of image data into the graphics memory, and a data-read control circuit that transfers the image data from the graphics memory to the frame memory. The data-write control circuit outputs a write-end signal at the completion of the writing of a frame of image data into the graphics memory.

The invented matrix-type display device further includes a synchronizing circuit that generates a read-start signal from the first frame synchronization signal occurring after a write-end signal. The read-start signal causes the read-control circuit to start transferring image data from the graphics memory to the frame memory.

The writing of image data into the frame memory is thereby synchronized with the reading of image data out of the frame memory. The synchronization is arranged so that the write address never overtakes the read address during the reading of a frame of image data. When a moving image is displayed, accordingly, each individual frame is displayed correctly, with no mixing of data from two consecutive frames.

The invented matrix-type display device may also have a delay circuit that delays the frame synchronization signal before input to the synchronizing circuit. The delay can be set to provide optimal read-write synchronization for the frame memory, for various different types of matrix display panels.

The delay circuit preferably also receives the line synchronization signal, and delays the frame synchronization signal by a predetermined number of line synchronization pulses. Optimal read-write synchronization of the frame memory can then be maintained despite clock-signal frequency variations.

The matrix display panel may be, for example, a liquid-crystal display panel of the reflective type, the reflective semi-transmissive type, the active-matrix type, or the fast-response super-twisted birefringent type. Alternatively, the matrix display panel may be an organic electroluminescent panel or an active-matrix organic electroluminescent panel.

DETAILED DESCRIPTION OF THE INVENTION

Figure 10:
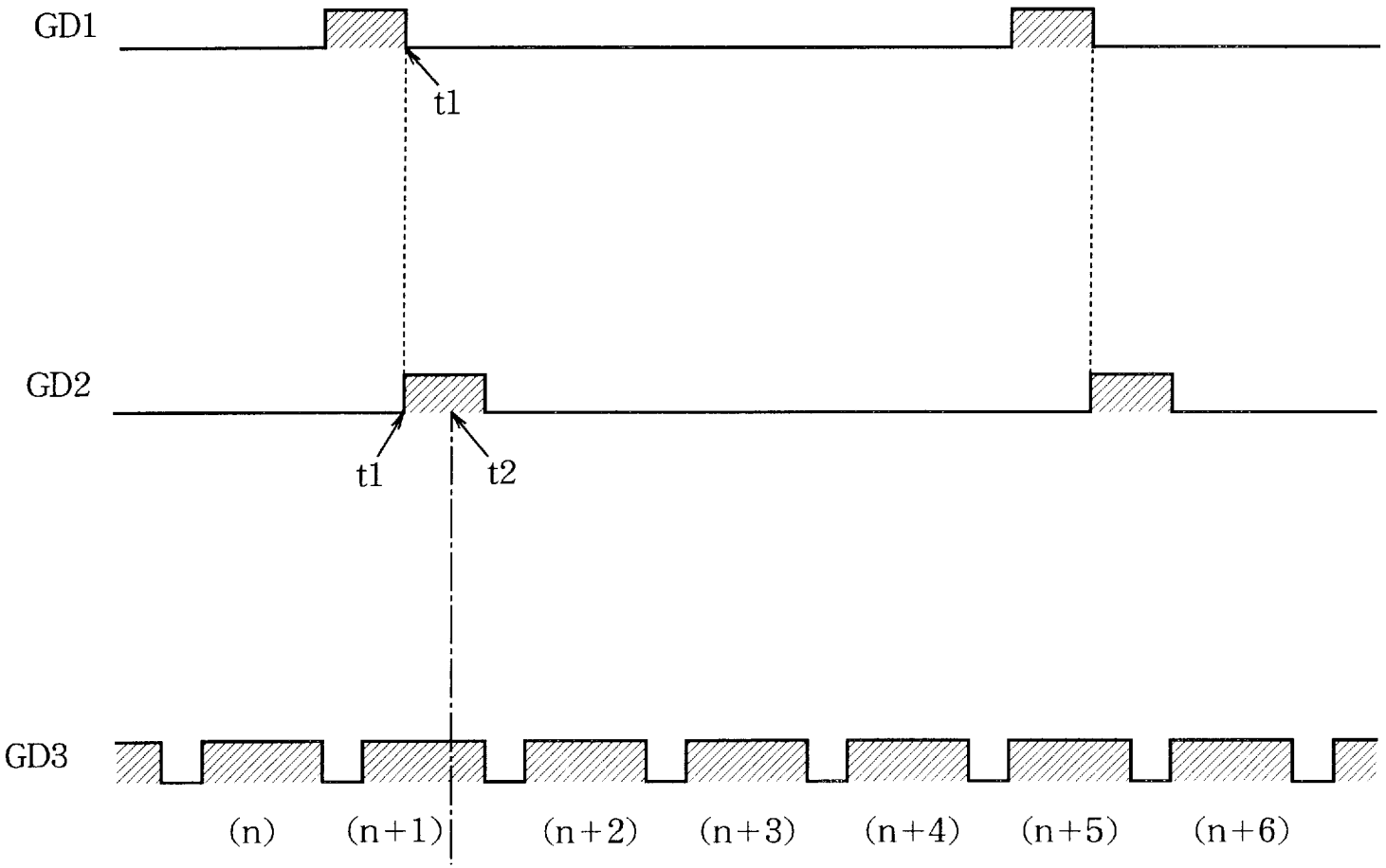
FIG. 10 is a timing waveform diagram illustrating the operation of the matrix-type display panel in FIG. 9.
Figure 11A:
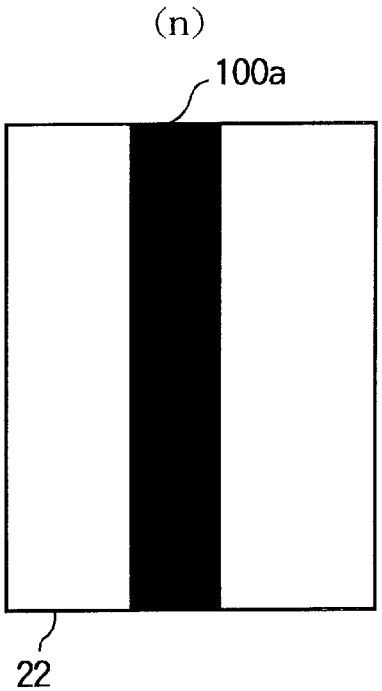
FIGS. 11A, 11B, and 11C show a thick vertical line moving from left to right on the matrix display panel in FIG. 9.
Figure 11B:
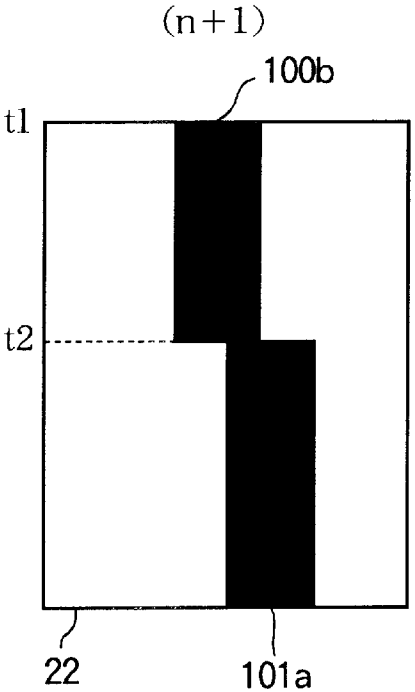
Figure 11C:
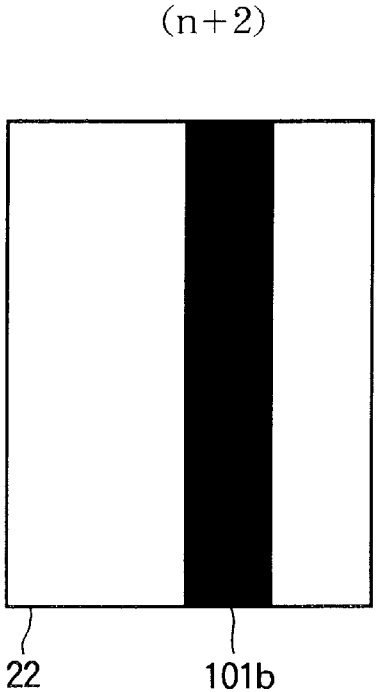

Matrix-type display devices according to the present invention will be described specifically below on the basis of drawings showing embodiments thereof. In the following drawings, those parts having the same functions as in the conventional matrix-type display device 9 described above using FIGS. 9 to 11 are shown with the same reference characters, and redundant descriptions will be omitted.

1. First Embodiment

Figure 1:
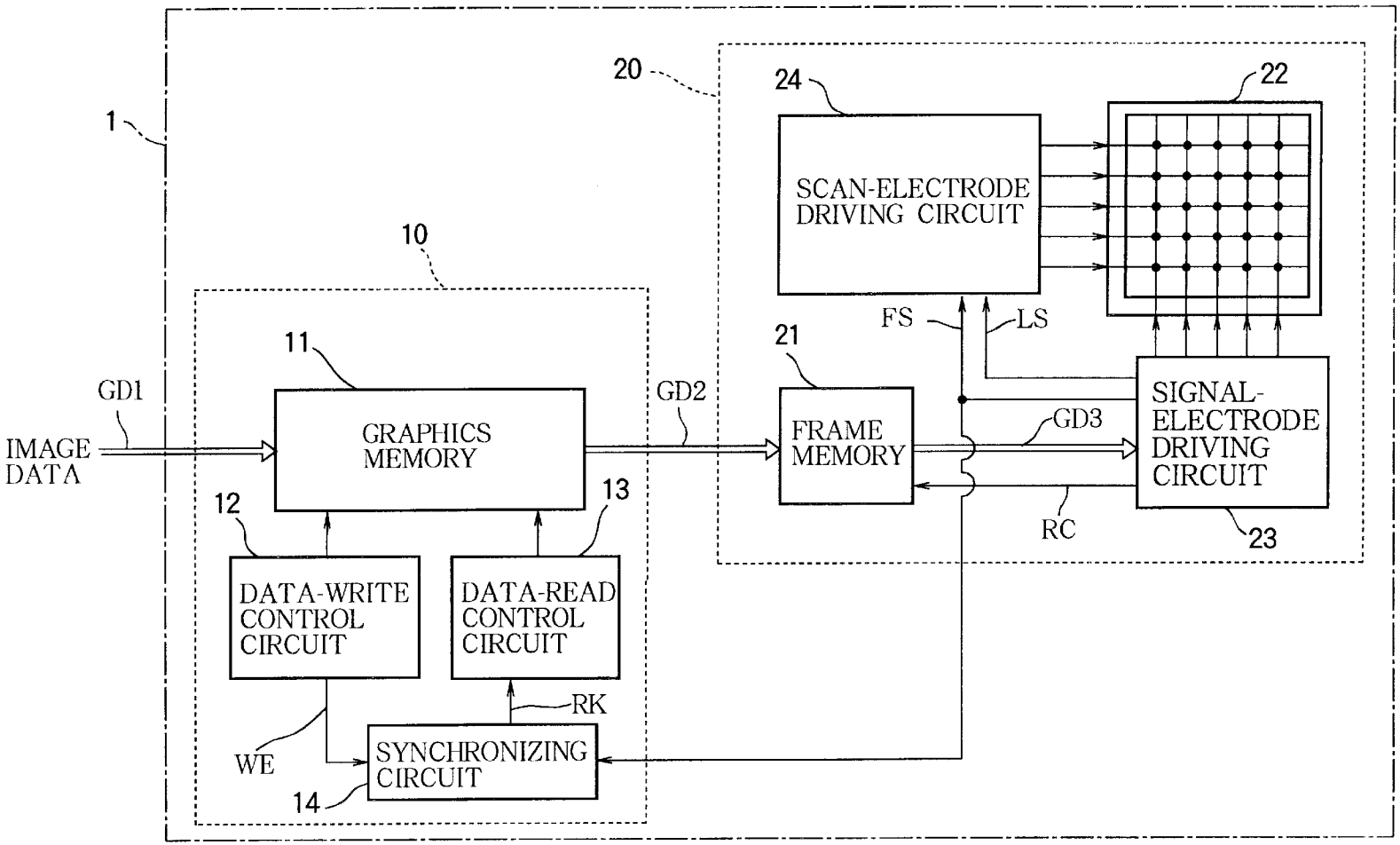
FIG. 1 is a block diagram showing the structure of a first matrix-type display device embodying the present invention.

FIG. 1 is a drawing showing a first matrix-type display device embodying the present invention.

Figure 9:
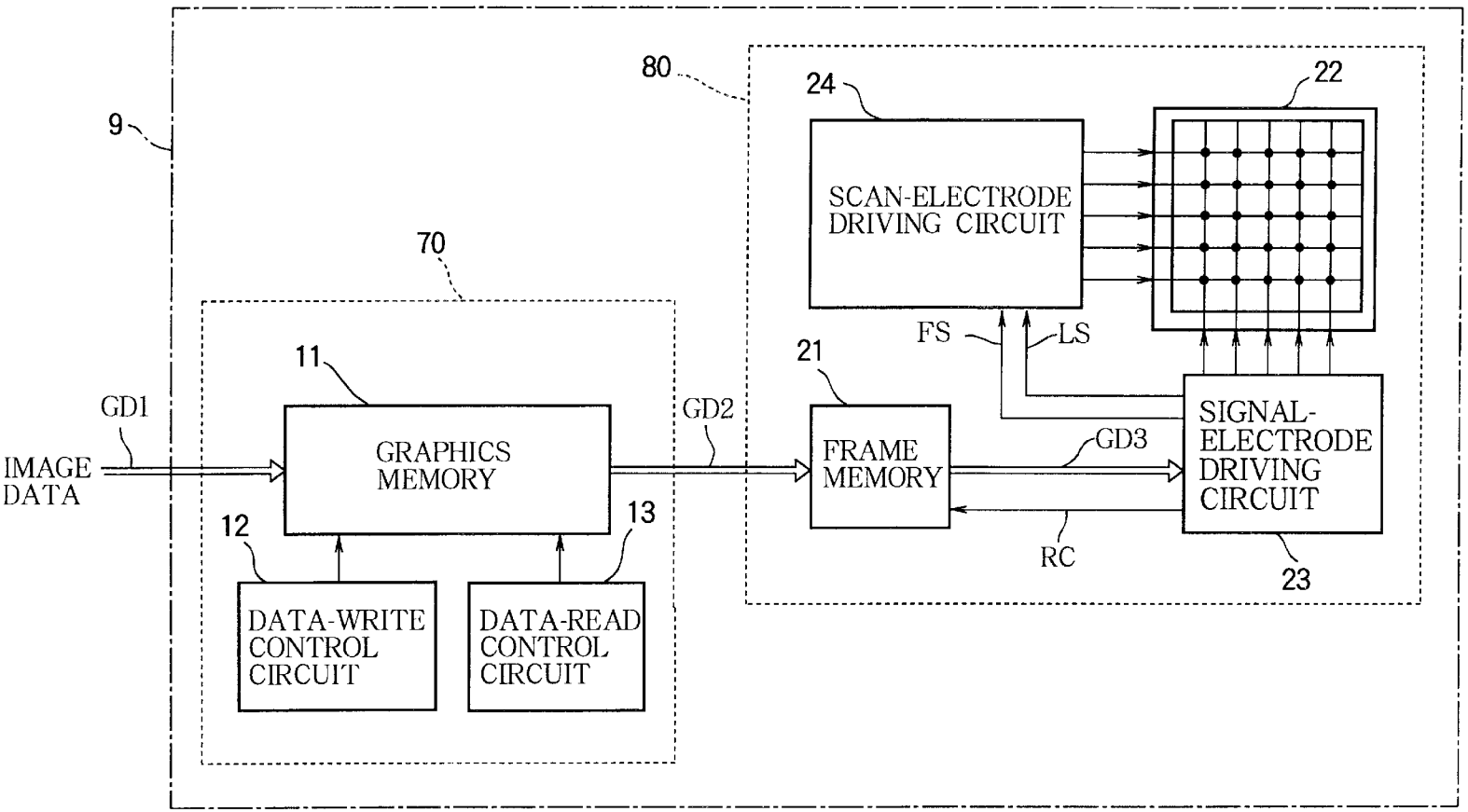
FIG. 9 PRIOR ART
FIG. 9 is a block diagram showing the structure of a conventional matrix-type display device with a built-in frame memory.

The principal way in which the matrix-type display device 1 of FIG. 1 differs from the matrix-type display device 9 of FIG. 9 is that, in the input control unit 10, there is a synchronizing circuit 14 that outputs a read-start signal to the data-read control circuit 13 in synchronization with the frame synchronization signal FS output from the signal-electrode driving circuit 23 in the display-panel module 20. Concomitant with the addition of the above synchronizing circuit 14, the data-write control circuit 12 is adapted to be able to output a write-end signal WE to the synchronizing circuit 14, and the signal-electrode driving circuit 23 is adapted to be able to send the frame synchronization signal both to the scan-electrode driving circuit 24 and the synchronizing circuit 14. As for the rest of the structure, it is the same as in the conventional matrix-type display device 9 shown in FIG. 11, so a description will be omitted.

Figure 2:
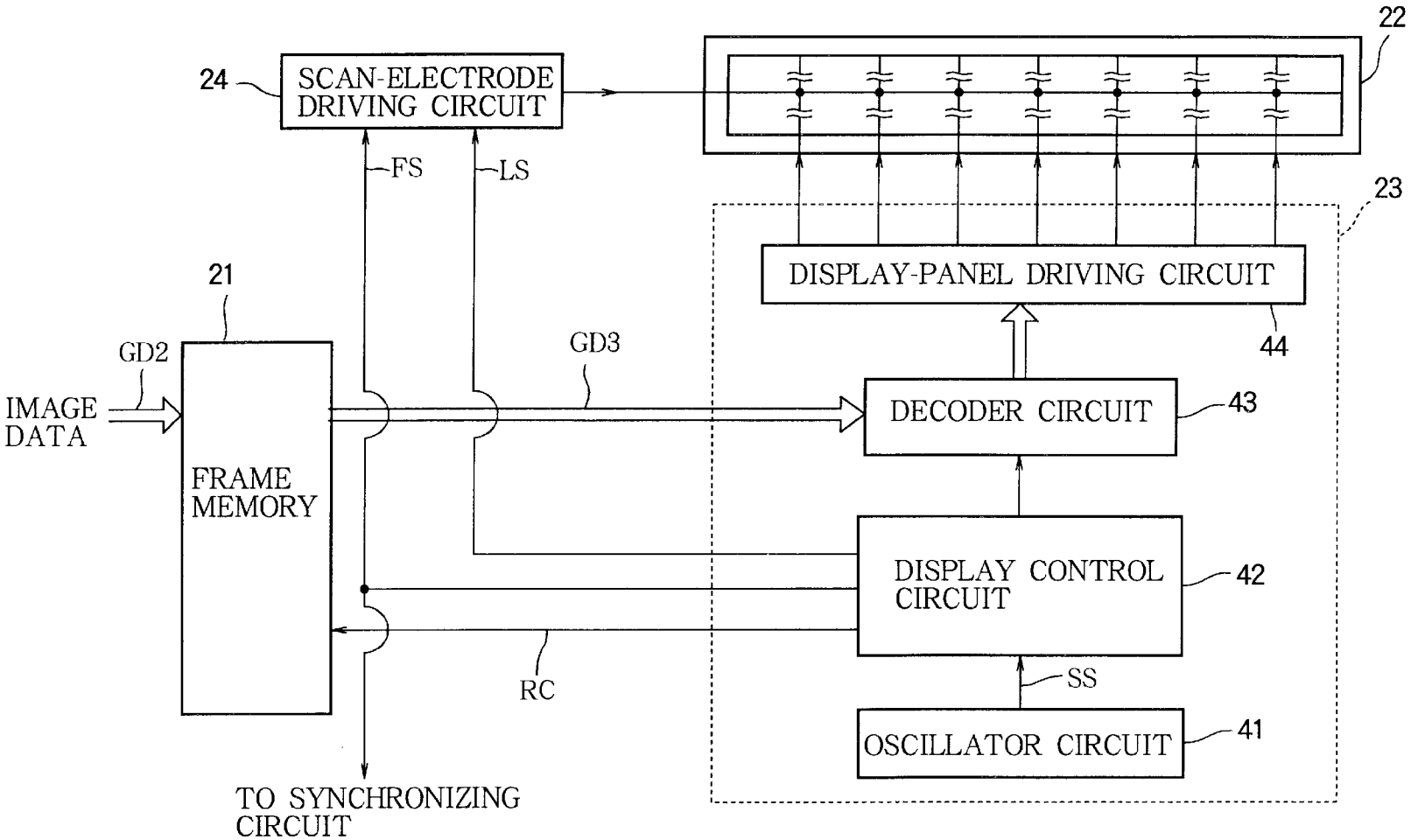
FIG. 2 is a block diagram showing the internal structure of the signal-electrode driving circuit in FIG. 1.

FIG. 2 is a block diagram showing the internal structure of the signal-electrode driving circuit 23 in the display-panel module 20 in FIG. 1.

In the signal-electrode driving circuit 23, reference numeral 41 denotes an oscillator circuit that generates a clock signal (reference signal) SS, which becomes a reference for displaying images on the matrix display panel 22. Reference numeral 42 denotes a display control circuit that outputs the read control signal RC to the frame memory 21, outputs the frame synchronization signal FS and line synchronization signal LS to the scan-electrode driving circuit 24, and outputs a synchronization signal for decoding the image data to a decoder circuit 43, described below, based on the reference signal SS. The frame synchronization signal FS is also output from the display control circuit 42 to the synchronizing circuit 14. Reference numeral 43 denotes the decoder circuit, which converts (decodes) the coded image data GD3 to image-displayable image data, based on image data coding rules and the synchronization signal from the display control circuit 42. Reference numeral 44 denotes a display-panel driving circuit that drives the signal electrodes of the matrix display panel 22 by applying voltages thereto, on the basis of the decoded image data.

Figure 3:
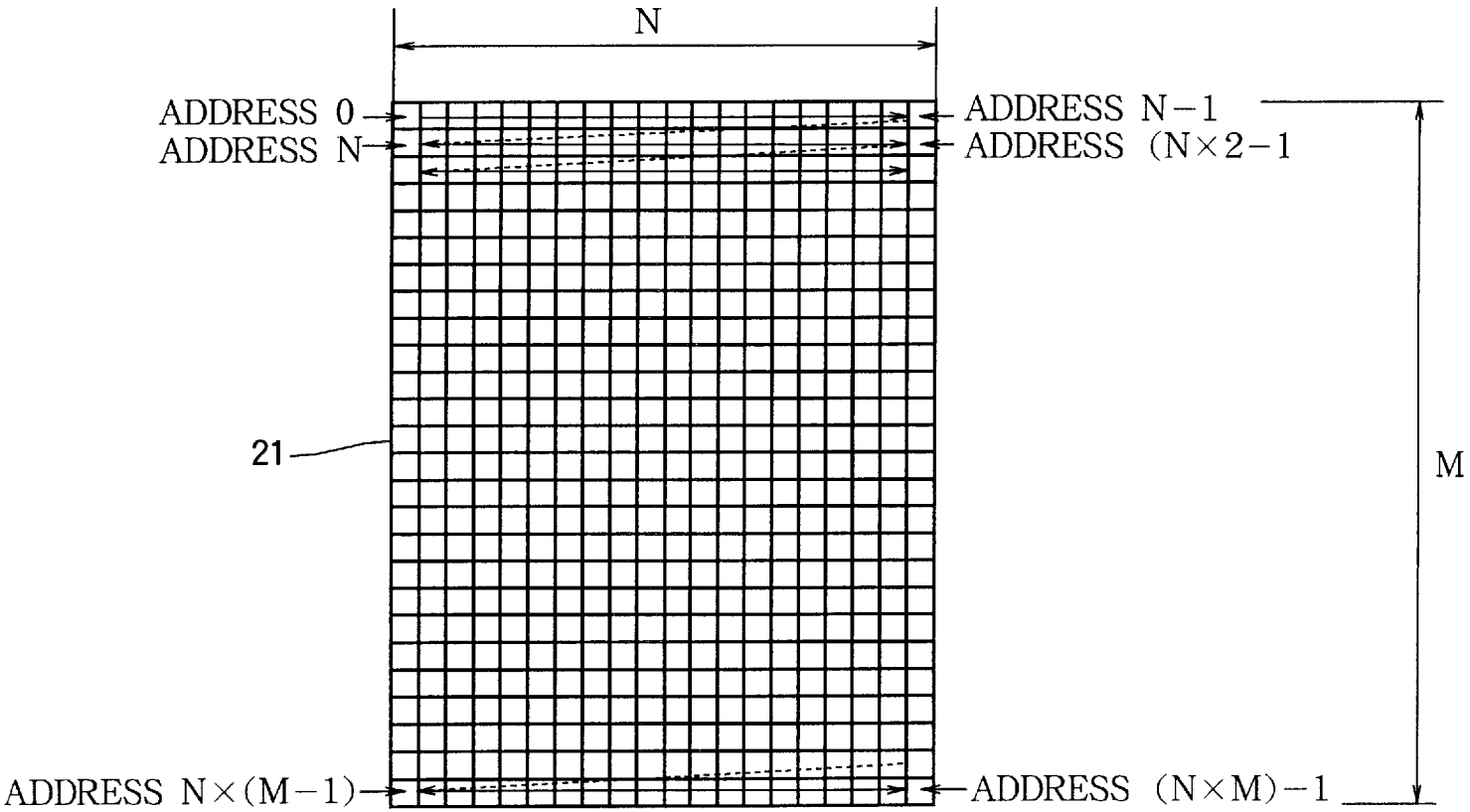
FIG. 3 is a drawing showing the address structure of the frame memory in FIG. 1.

FIG. 3 is a drawing showing the address structure of the frame memory 21 in FIG. 1.

The data-read control circuit 13 writes one screen of image data read from the graphics memory 11 in sequence from address 0 to address N×M−1 in the frame memory 21, which is an N×M frame memory, as shown in FIG. 3, N being the horizontal dot count and M the vertical line count in the matrix-type display device 1. In further detail, the data-read control circuit 13 writes the image data in the first line from address 0 to address N−1, then writes the image data in the second line from address N to address N×2−1. Writing each line of image data in similar fashion, it completes the writing of one screen by writing the M-th line, which is the last line, from address N×(M−1) to address N×M−1.

The data read out after being temporarily written in the frame memory 21 are not limited to image data, but may be, for example, data constituting characters or the like. Furthermore, in a mobile telephone supporting moving images according to the IMT-2000 standard, due to restrictions on data communication speed and the like, for the present, transfer speeds up to about fifteen screens per second are envisioned as the data transfer speed of the frame memory 21. It is expected, however, that this transfer speed will increase to about thirty screens per second in the future.

Next, the operation of the matrix-type display device 1 will be described with reference to the timing diagram in FIG. 4, in addition to FIGS. 1 to 3.

The image data GD1 input to the input control unit 10 of the matrix-type display device 1 from the outside through a communication function or the like are temporarily stored in the graphics memory 11 under control of the data-write control circuit 12. When the process of storing one frame of image data GD1 in the graphics memory 11 ends at timing t1 as shown in FIG. 4, the write-end signal WE is output from the data-write control circuit 12 to the synchronizing circuit 14. The synchronizing circuit 14 is reset by the input of this write-end signal WE, and then carries out the operations below.

Figure 4:
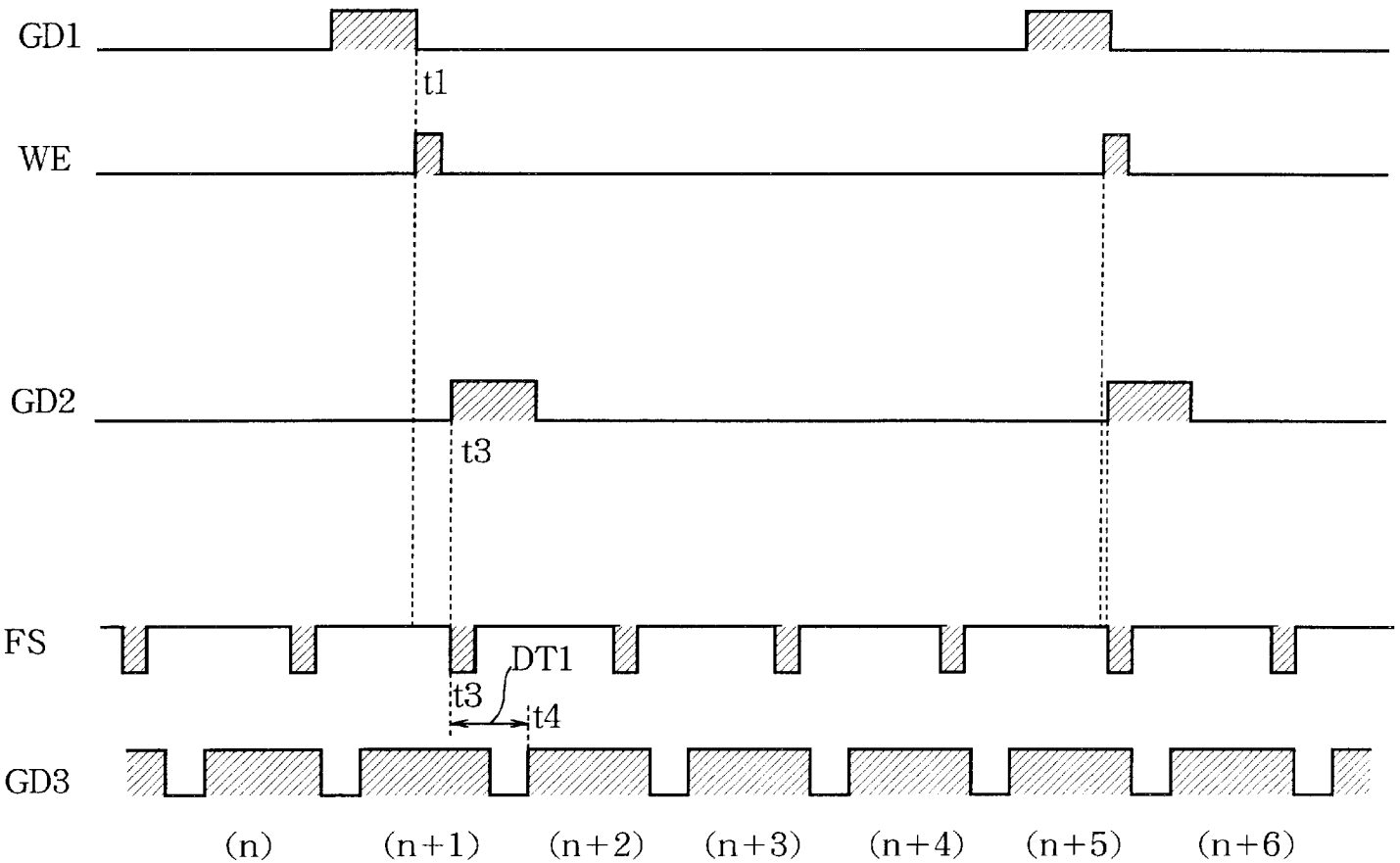
FIG. 4 is a timing waveform diagram illustrating the operation of the matrix-type display device in FIG. 1.

After receiving the write-end signal WE, the synchronizing circuit 14 waits for the next frame synchronization signal FS to be input, and outputs a read-start signal RK to the data-read control circuit 13 in synchronization of the input thereof, at timing t3 in FIG. 4. Thereupon, the image data GD1 temporarily stored in the graphics memory 11 are read, starting at timing t3, and transferred as image data GD2 to the frame memory 21 by the data-read control circuit 13.

Meanwhile, in the display-panel module 20, as shown in FIG. 4, the image data stored in the frame memory 21 are read out periodically as image data GD3 by the signal-electrode driving circuit 23, in a refresh cycle based on the reference signal (clock signal) SS generated by the oscillator circuit 41, and input to the signal-electrode driving circuit 23. The frames of image data GD3 read from the frame memory 21 are numbered n, (n+1), (n+2), and so on, the frame number increasing in temporal order. Incidentally, n is a non-negative integer.

In the signal-electrode driving circuit 23, the display control circuit 42 generates the read control signal RC and outputs it to the frame memory 21, outputs a decoding synchronization signal to the decoder circuit 43, and generates the frame synchronization signal FS and line synchronization signal LS and outputs them to the scan-electrode driving circuit 24, based on the reference signal SS. The decoder circuit 43 decodes the input image data GD3 to image data that are image-displayable on the matrix display panel 22, based on the synchronization signal from the display control circuit 42 and the image data decoding rules. The display-panel driving circuit 44 generates control signals from the decoded image data and outputs them to the signal electrodes of the matrix display panel 22. The scan-electrode driving circuit 24 generates control signals for the scan electrodes of the matrix display panel 22 and outputs them, based on the frame synchronization signal FS and line synchronization signal LS.

As can be seen by referring to FIG. 4, the transfer of image data GD2 from the graphics memory 11 to the frame memory 21 starts (at timing t3) before the reading of the image data GD3 for frame (n+2) from the frame memory 21 starts (at timing t4), and ends before the reading of the image data GD3 for frame (n+2) ends. Accordingly, it is always the newly transferred and stored image data GD2 that are read as the image data GD3 for frame (n+2); no switchover from old to new image data occurs during the reading of frame (n+2) from the frame memory 21.

Because of to the timing of the frame synchronization signal FS, that is, because of the length of the delay DT1 from timing t3 to timing t4 in FIG. 4, the transfer of the image data GD2 from the graphics memory 11 to the frame memory 21 also starts after the reading of the image data GD3 for frame (n+1) starts, and ends after the reading of the image data GD3 for frame (n+1) ends. Accordingly, it is always the previously transferred and stored image data that are read as the image data GD3 for frame (n+1); no switchover from old to new image data occurs during the reading of frame (n+1).

Figure 5A:
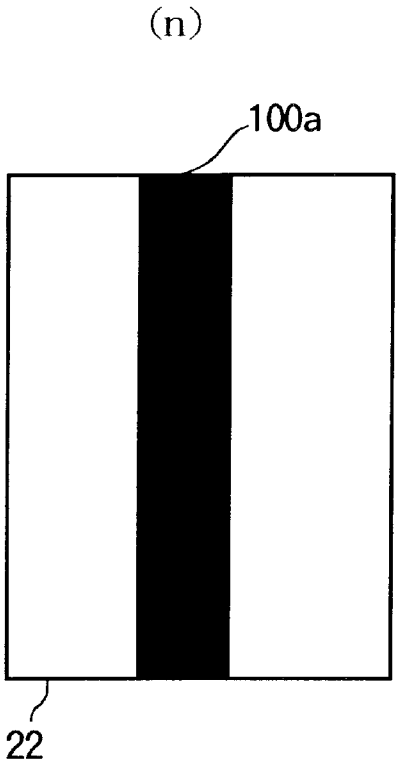
FIGS. 5A, 5B, and 5C show a thick vertical line moving from left to right on the matrix display panel in FIG. 1.
Figure 5B:
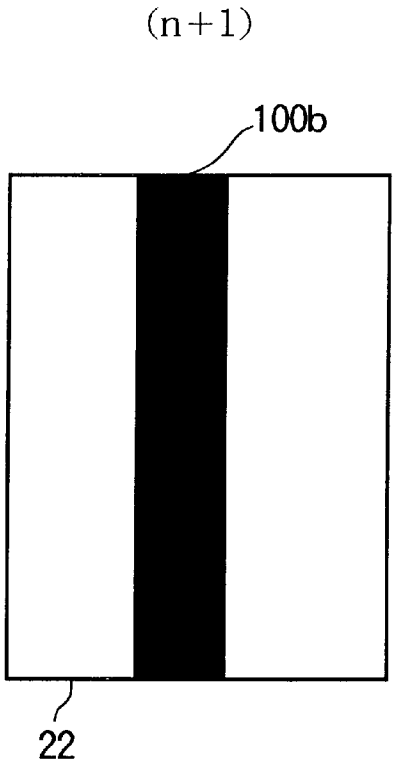
Figure 5C:
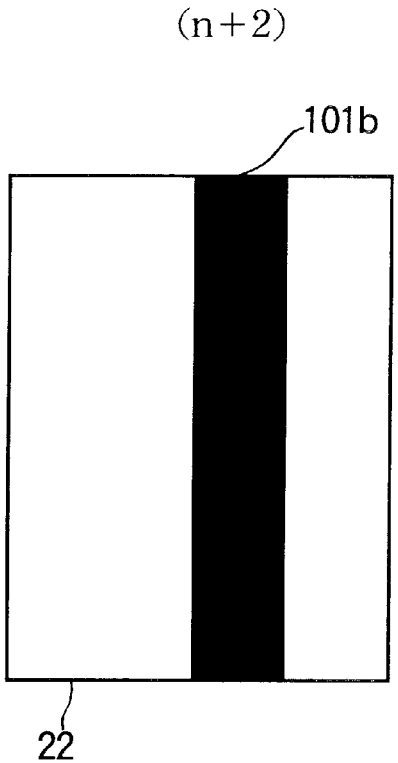

FIGS. 5A to 5C are drawings showing a thick vertical line moving from the left edge toward the right edge on the matrix display panel 22 of the matrix-type display device 1. These drawings illustrate frames n, (n+1), and (n+2) in FIG. 4.

First, in frame n, an image of a vertical line 100*a* is displayed with vertical continuity as in FIG. 5A.

Next, the same image data GD3 are read again from the frame memory 21 and an identical vertical line 100*b* is displayed in frame (n+1), as in FIG. 5B. During the reading of this frame (n+1), the data-read control circuit 13 begins writing new image data GD2 into the frame memory 21, but the GD2 write address lags the GD3 read address, so the newly written image data GD2 are not read yet.

The writing of new image data GD2 into the frame memory 21 continues during the next frame (n+2). The GD3 read address now lags the GD2 write address, so a completely new image is displayed, with a new continuous vertical line 101*b* shifted to the right as in FIG. 5C.

Thus in the matrix-type display device 1 of this first embodiment, since the image data GD2 are transferred from the graphics memory 11 to the frame memory 21 in synchronization with the frame cycle of the matrix display panel 22, the process of transferring the image data GD2 into the frame memory 21 and the process of reading the image data GD3 from the frame memory 21 to the signal-electrode driving circuit 23 do not match up at the same address, and the data transfer is controlled so that during one frame of the image displayed on the matrix display panel 22, there is no switchover to the next frame, so when a moving image is displayed, situations in which the image content of the upper part and lower part of one screen are temporally out of step do not occur, and a smooth picture can be displayed.

2. Second Embodiment

The first embodiment avoided the switching of the image to a newly written image midway through the image data GD3 read from the frame memory 21 by synchronizing the timing of the start of the transfer of image data GD2 from the graphics memory 11 to the frame memory 21 with the frame synchronization signal FS, with a delay time DT1 from the frame synchronization signal FS to the reading of the image data GD3 from the frame memory 21. If the delay time DT1 is increased, however, then the timing of the end of the transfer of image data GD2 approaches the timing of the end of the reading of the image data GD3 of frame (n+1) in FIG. 4, and if the timing of the end of the transfer of image data GD2 overtakes the timing of the end of the reading of image data GD3, the possibility again arises that the image displayed on the matrix display panel 22 will switch over, partway through one frame, to the next frame.

The second embodiment, described below, adjusts the delay time from the transfer of image data GE2 to the reading of image data GD3 so that it does not become too long.

Figure 6:
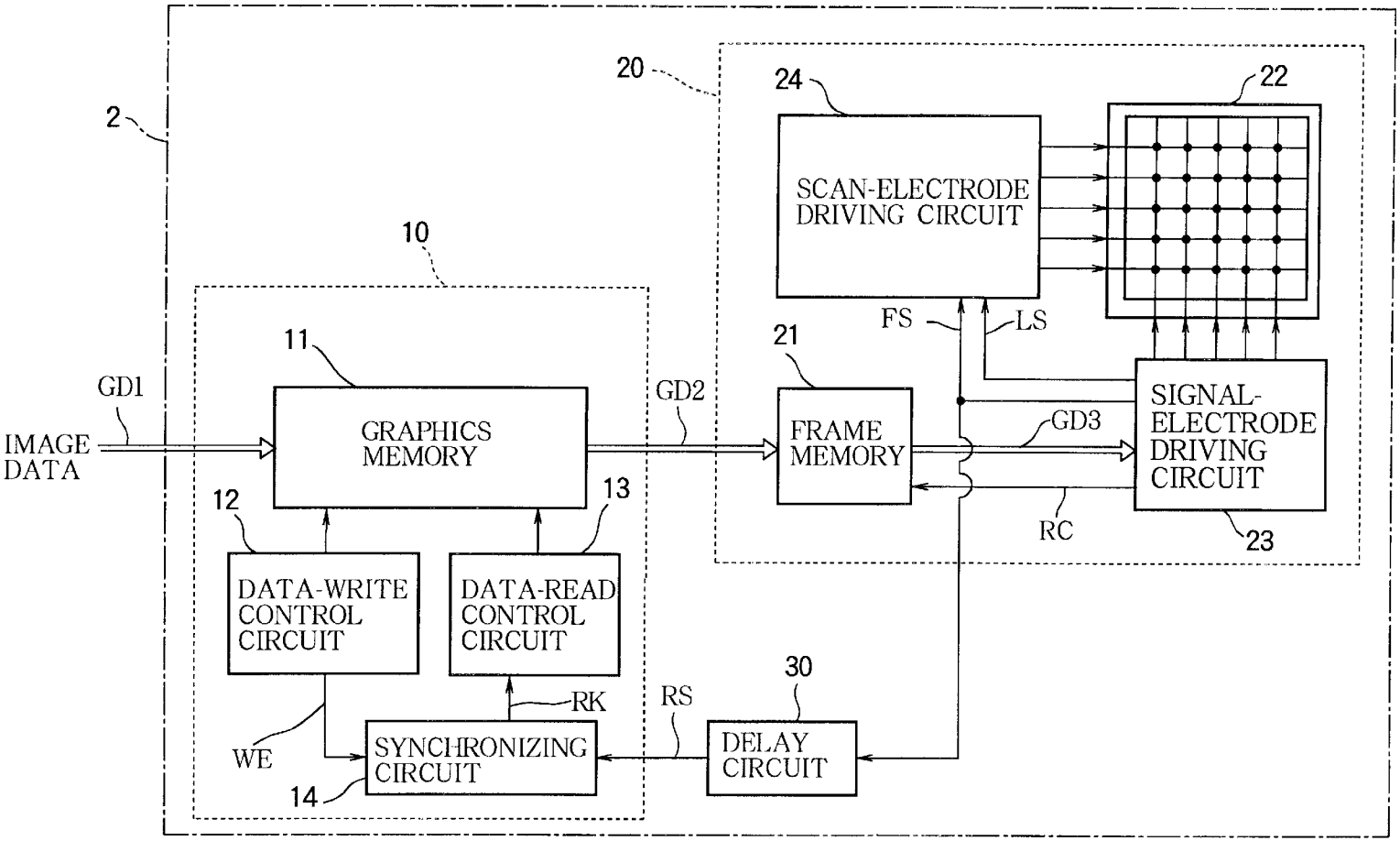
FIG. 6 is a block diagram showing the structure of a second matrix-type display device embodying the present invention.

FIG. 6 is a block diagram showing the structure of the matrix-type display device of the second embodiment of the present invention.

The principal difference between the matrix-type display device 2 in FIG. 6 and the matrix-type display device 1 in FIG. 1 is that a delay circuit 30 is provided to delay the frame synchronization signal FS output from the signal-electrode driving circuit 23 by a predetermined time to synchronize it with the timing of the end of the reading of the image data GD3 of an arbitrary frame, and output it as a read synchronization signal RS. As for the rest of the structure, it is the same as in the matrix-type display device 1 of the first embodiment, shown in FIG. 1, so a description will be omitted.

Next, the operation of the matrix-type display device 2 will be described with reference to the timing diagram in FIG. 7, in addition to FIG. 6.

Figure 7:
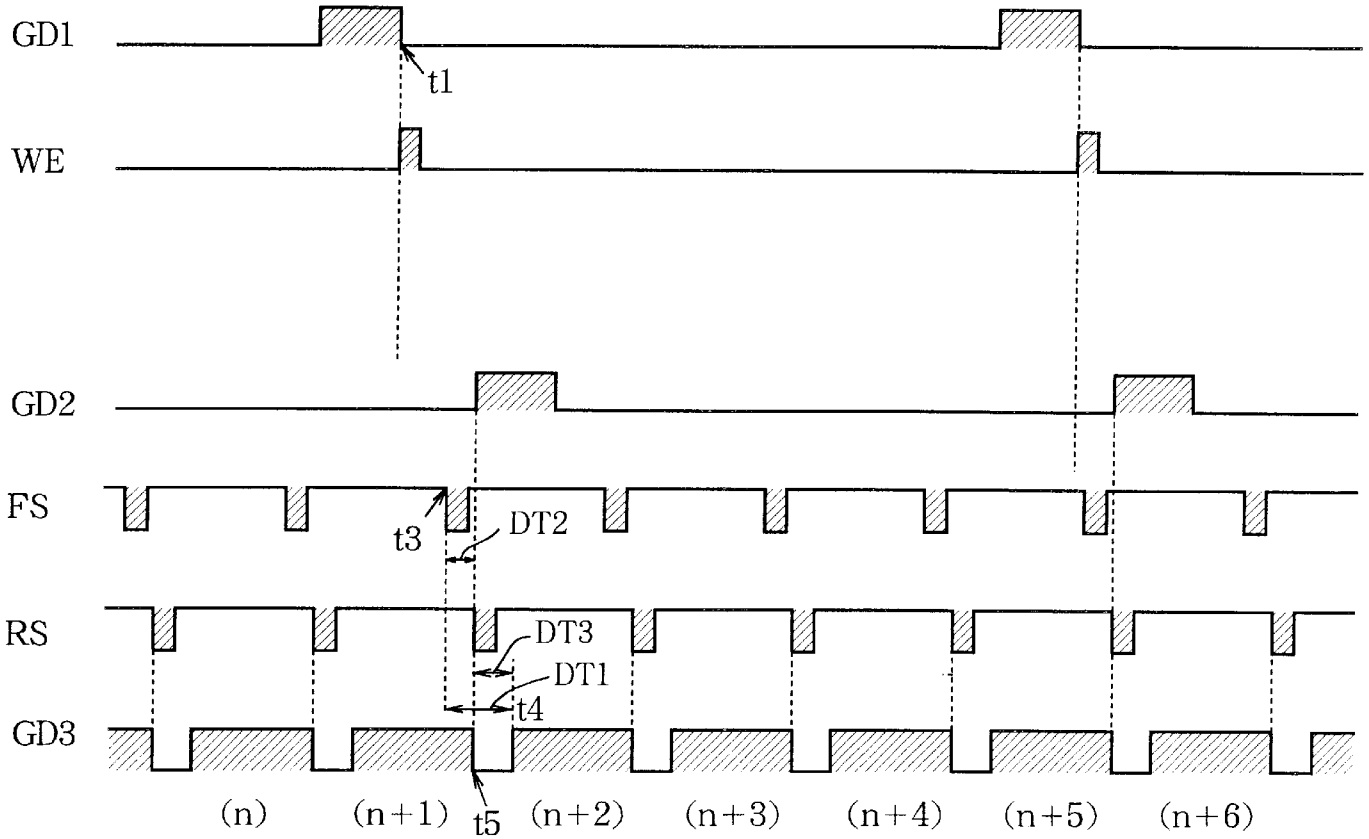
FIG. 7 is a timing waveform diagram illustrating the operation of the matrix-type display device in FIG. 6.

The GD1, WE, FS, and GD3 waveforms in FIG. 7 are identical to the corresponding waveforms in FIG. 4. The waveform of the read synchronization signal RS is delayed from the frame synchronization signal FS by a predetermined amount DT2 by the delay circuit 30, so as to be synchronized with the timing t5 of the end of the reading of the image data GD3 of frame (n+1). The transfer of the image data GD2 starts in synchronization with the read synchronization signal RS at timing t5.

Since the delay time DT1 from the frame synchronization signal FS to the timing t4 of the start of the reading of the image data GD3 of the (n+2)-th frame may be too long, the frame synchronization signal FS is not input directly to the synchronizing circuit 14, but the read synchronization signal RS delayed in the delay circuit 30 is input to the synchronizing circuit 14, producing a delay time DT3 obtained by shortening delay time DT1 by the delay time DT2 of the delay circuit 30. The read synchronization signal RS is generated in synchronization with the timing t5 of the end of the reading of the image data GD3 of the (n+1)-th frame, so a situation in which, midway through one frame of the image displayed on the matrix display panel 22, there is a switchover to the image of the next frame can be eliminated.

By thus adding a delay circuit 30 that outputs a read synchronization signal RS, obtained by delaying the frame synchronization signal FS, as a pre-stage of the frame synchronization signal input section of the synchronizing circuit 14, the second embodiment can set an optimal delay quantity in the delay circuit 30 for matrix display panels having different response speeds, such as a TFT or other active-matrix liquid-crystal display panel with a response speed of about 30–50 msec, a fast-response STN liquid-crystal panel with a response speed of about 70–80 msec, or an organic EL panel with a response speed of a few microseconds; the delay time of the output read synchronization signal RS can be set so that it is not too long, regardless of the type of matrix display panel; the second embodiment can accordingly display smooth moving images even if the frame synchronization signal FS from the signal-electrode driving circuit 23 is inappropriate as the transfer timing of image data GD2.

3. Third Embodiment.

The second embodiment eliminated the situation in which, midway through one frame of the image displayed on the matrix display panel 22, there is a switchover to the image of the next frame by adding a delay circuit 30 to which the frame synchronization signal FS is input, and which outputs that signal FS as a read synchronization signal RS optimally delayed so as to synchronize with the timing t5 of the end of the reading of the image data GD3, as a pre-stage of the frame synchronization signal input section of the synchronizing circuit 14, but the clock signal used in the delay circuit 30 is not necessarily the same as the clock signal (reference signal SS) of the signal-electrode driving circuit 23.

If reference signal SS differs from the clock signal used in the delay circuit 30, then due to variations in their oscillator circuits, it may happen that the read synchronization signal RS cannot be set to the optimal delay quantity.

The third embodiment, described below, synchronizes the read synchronization signal RS to the internal clock signal (reference signal SS) of the signal-electrode driving circuit 23, so that it is not easily affected by oscillator-circuit variations.

Figure 8:
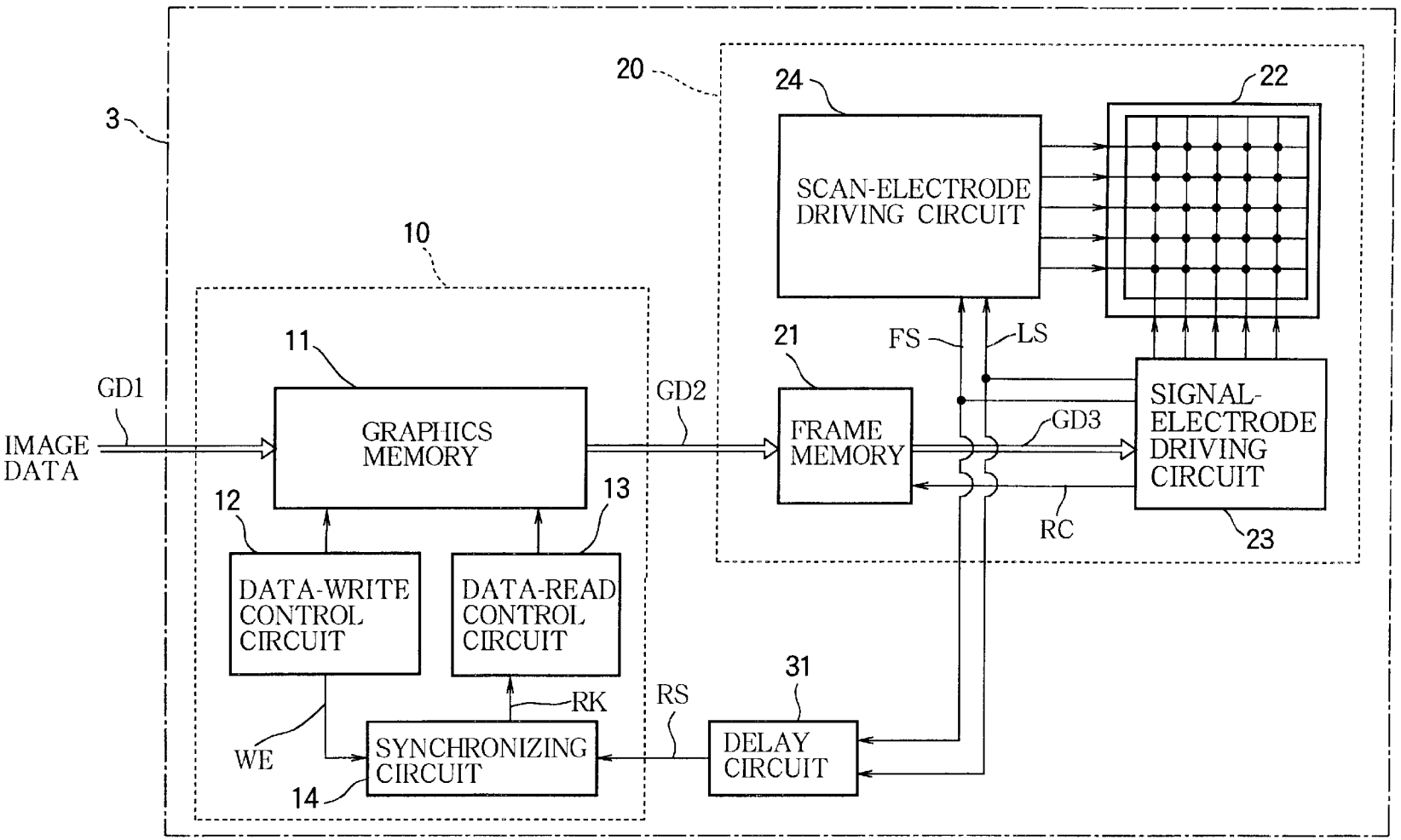
FIG. 8 is a block diagram showing the structure of a third matrix-type display device embodying the present invention.

FIG. 8 is a block diagram showing the structure of the matrix-type display device of the third embodiment of the present invention.

The principal difference between the matrix-type display device 3 in FIG. 8 and the matrix-type display device 2 in FIG. 6 is that the line synchronization signal LS, as well as the frame synchronization signal FS output from the signal-electrode driving circuit 23, is input to the delay circuit 31. The third embodiment is adapted to use the line synchronization signal LS as the clock signal of the delay circuit 31. As for the rest of the structure, it is the same as in the matrix-type display device 2 of the second embodiment, shown in FIG. 6, so a description will be omitted.

Next, the operation of the matrix-type display device 3 will be described with reference to the timing diagram in FIG. 7 of the second embodiment, as well as to FIG. 8.

When the clock signal used in the delay circuit 30 differs from reference signal SS, the read synchronization signal RS in FIG. 7 fails to match the timing t5 of the end of the reading of the image data GD3 of frame (n+1), for example. Then the transfer of image data GD2 synchronized with the read synchronization signal RS also fails to match the timing t5 of the end of the reading of image data GD3, and the possibility of the occurrence of a switchover, midway through one frame of the image displayed on the matrix display panel 22, to the image of the next frame arises once again.

As shown in FIG. 2, however, the frame synchronization signal FS and line synchronization signal LS output from the signal-electrode driving circuit 23 are generated on the basis of the same reference signal SS from the oscillator circuit 41, so even if variations between oscillator circuits occur, the synchronization between the frame synchronization signal FS and line synchronization signal LS does not vary.

The third embodiment is therefore structured to input the line synchronization signal LS as the clock signal of the delay circuit 31, as shown in FIG. 8. A signal obtained by delaying the frame synchronization signal FS by a preset number of pulses of the line synchronization signal LS can then be output from the delay circuit 31 as the read synchronization signal RS. In this case, the amount by which the read synchronization signal RS is delayed from the frame synchronization signal FS does not vary, so the transfer of image data GD2 in synchronization with the read synchronization signal RS can be synchronized reliably with the timing t5 of the end of the reading of the image data GD3 of frame (n+1). Accordingly, the situation in which, midway through one frame of the image displayed on the matrix display panel 22, there is a switchover to the image of the next frame can be eliminated.

The third embodiment thus inputs the line synchronization signal LS, as well as the frame synchronization signal FS, to the delay circuit 31, and outputs the read synchronization signal RS by delaying the frame synchronization signal FS with the line synchronization signal LS as a clock, so the timing of the generation of the read synchronization signal RS does not vary due to variations in oscillator circuits or the like, a read synchronization signal RS having an optimal delay can be output, and a read synchronization signal RS of the optimal delay, delayed by a fixed phase quantity from the frame synchronization signal FS, can be set, so a smooth, stable moving image can be displayed regardless of the type of matrix display panel, whether it is an active-matrix liquid-crystal panel, a fast-response STN liquid-crystal panel, an organic EL panel, or the like, for example, without being affected by oscillator-circuit variations, even in conditions in which oscillator-circuit frequency drift etc. is likely to occur.

When the matrix display panel in the embodiments above is a liquid-crystal panel, it can be classified as being of the transmissive type, the reflective type, or the reflective semi-transmissive type. The transmissive type of liquid-crystal panel requires internal illumination such as back-lighting to make the content of the image display visible, and back-lighting requires electrical power, so it is difficult to use in mobile information-terminal equipment, such as a mobile telephone or the like, for which low power consumption is desired. The reflective type does not require electric power for back-lighting, because the content of the displayed image is made visible by external light reflected from a reflecting plate provided on the whole of the back surface, making it suitable for mobile information-terminal equipment, such as a mobile telephone or the like, for which low power consumption is desired. The reflective semi-transmissive type provides a semi-transmissive reflecting plate such as a mesh-type panel on the back surface, so that the content of the image display can be made visible by the reflection of external light and by internal illumination; normally, as in the reflective type, the electric power for back-lighting is unnecessary, but in addition, when the exterior surroundings are dark the display can be viewed by the use of internal illumination, so it is suitable for mobile information-terminal equipment, such as a mobile telephone or the like, for which low power consumption is desired, and is more convenient because visibility in dark places is improved.

If a liquid-crystal display panel of the active-matrix type is used as the matrix display panel, compared with the conventional liquid-crystal display panel of the STN type with a slow response speed, the response speed and the contrast of the display section with respect to the surroundings are improved, so even when moving images with vigorous motion or moving images that move rapidly are displayed, a smooth, stable moving image can be displayed, and its visibility can be improved.

If a fast-response STN liquid-crystal display panel is used as the matrix display panel, compared with the conventional liquid-crystal display panel of the STN type with a slow response speed, the response speed is improved, so even when moving images with vigorous motion or moving images that move rapidly are displayed, a smooth, stable moving image can be displayed, while lower power consumption and low cost are maintained.

If an organic electroluminescent display panel is used as the matrix display panel, compared with the conventional liquid-crystal display panel of the STN type with a slow response speed, the response speed is improved as with a liquid-crystal display panel of the active-matrix type. Moreover, with an organic electroluminescent panel, the contrast of the display section with respect to its surroundings is improved through the emission of light by the display section itself, so not only can a smooth, stable moving image be displayed, but in addition, visibility can be improved even more than with a liquid crystal, so the image quality can be further improved, and the display can be slimmed because back-lighting is not required.

If an organic electroluminescent display panel of the active-matrix type is used as the matrix display panel, then a smooth, stable moving image can be displayed, even when moving images with vigorous motion or moving images that move rapidly are displayed, and visibility can be improved even more than with a liquid crystal, so the image quality can be further improved, and the display can be slimmed.

According to one aspect of the invention, since image data are transferred from the graphics memory to the frame memory in synchronization with the frame cycle of the matrix-type display device, the process of transferring the image data into the frame memory and the process of reading the image data from the frame memory to the signal-electrode driving circuit do not match up at the same address, and the data transfer is controlled so that during one frame of the image displayed on the matrix display panel, it does not switch to the next frame, so when a moving image is displayed, situations in which the image content of the upper part and lower part of one screen are temporally out of step do not occur, and a smooth picture can be displayed.

According to another aspect of the invention, by the addition of a delay circuit that outputs a read synchronization signal, obtained by delaying the frame synchronization signal, as a pre-stage of the frame synchronization signal input section of the synchronizing circuit, it becomes possible to set an appropriate delay quantity in the delay circuit, not making the delay time too long, for matrix display panels having different response speeds, and output it as a read synchronization signal, so in addition to the above effects, regardless of the type of matrix display panel, it can display a smooth moving image even if the frame synchronization signal from the signal-electrode driving circuit is inappropriate as the transfer timing of image data.

According to yet another aspect of the invention, the line synchronization signal, as well as the frame synchronization signal, is input to the delay circuit, and the read synchronization signal is output by delaying the frame synchronization signal with the line synchronization signal as a clock, so the timing of the generation of the read synchronization signal does not vary due to variations in oscillator circuits or the like, a read synchronization signal having the optimal delay can be output, and a read synchronization signal of the optimal delay, delayed by a fixed phase quantity from the frame synchronization signal, can be set, so in addition to the effects described above, a smooth, stable moving image can be displayed regardless of the type of matrix display panel, without being affected by oscillator-circuit variations, even in conditions in which oscillator-circuit frequency drift etc. is likely to occur.

According to a further aspect of the invention, a liquid-crystal display panel is used as the display panel of the matrix-type display device, so in addition to the effects described above, a matrix-type display device satisfying the conditions of reduced power consumption and reduced thickness and weight, thus optimal for use in mobile information terminals such as mobile telephones and the like, can be provided.

According to a still further aspect of the invention, a reflective liquid-crystal panel, not requiring internal illumination, is used as the display panel of the matrix-type display device, so in addition to the effects described above, a matrix-type display device with even lower power consumption can be provided.

According to a yet further aspect of the invention, a reflective semi-transmissive liquid-crystal display panel, not requiring internal illumination when external light can be used, but able to employ internal illumination when the exterior surroundings are dark, is used as the display panel of the matrix-type display device, so in addition to the effects described above, a convenient matrix-type display device can be provided.

According to a still further aspect of the invention, an active-matrix liquid-crystal display panel with a fast response speed is used as the display panel of the matrix-type display device, so a matrix-type display device can be provided that displays an image with good image quality and little motion blur, even when moving images with vigorous motion or moving images that move rapidly are displayed.

According to a yet further aspect of the invention, a fast-response STN liquid-crystal display panel is used as the display panel of the matrix-type display device, so a matrix-type display device can be provided that is low in cost and power consumption, and displays an image with little motion blur, even when moving images with vigorous motion or moving images that move rapidly are displayed.

According to one more aspect of the invention, an organic EL display panel is used as the display panel of the display panel of the matrix-type display device, so a matrix-type display device can be provided that is low in power consumption and has a thin structure, and displays an image with extremely good image quality, with almost no motion blur.

According to yet one more aspect of the invention, an active-matrix organic EL display panel is used as the display panel of the matrix-type display device, so a matrix-type display device can be provided that is low in power consumption and has a thin structure, and displays an image with extremely good image quality, with almost no motion blur, even when moving images with vigorous motion or moving images that move rapidly are displayed.

Incidentally, a liquid-crystal panel of the active-matrix type may have thin-film transistors or thin-film diodes. An organic EL panel of the active-matrix type may have thin-film transistors.

The invention is not limited to the embodiments described above; those skilled in the art will recognize that further variations are possible within the scope claimed below.

What is claimed is:

1. A matrix-type display device including:

a display panel provided with picture-element units at intersections in a matrix formed by a plurality of signal lines laid out in parallel columns and a plurality of scanning lines laid out in parallel rows;

a frame memory for storing image data to be displayed on the display panel a frame at a time;

a signal-electrode driving circuit for generating a frame synchronization signal and a line synchronization signal, and generating control signals for reading the image data from said frame memory and driving the signal lines of said display panel;

a scan-electrode driving circuit for generating control signals to drive the scanning lines of said display panel, according to said frame synchronization signal and said line synchronization signal;

a graphics memory for temporarily storing input image data a frame at a time;

a data-write control circuit for controlling writing of said input image data in the graphics memory; and a data-read control circuit for transferring the image data written in said graphics memory to the frame memory;

wherein said data-write control circuit outputs a write-end signal at the completion of the writing of one frame of image data in the graphics memory;

further including a synchronizing circuit for generating a read-start signal from said frame synchronization signal following said write-end signal, the read-start signal causing the data-read control circuit to start transferring the image data from the graphics memory to the frame memory.

2. The matrix-type display device of claim 1, further including a delay circuit for delaying said frame synchronization signal by a predetermined amount and supplying the delayed frame synchronization signal to said synchronizing circuit, thereby adjusting the timing of the read-start signal so that the transfer of data from said graphics memory to said frame memory ends after said signal-electrode driving circuit has read one frame of image data from said frame memory, and before said signal-electrode driving circuit has finished reading the next frame of image data.

3. The matrix-type display device of claim 2, wherein said delay circuit uses said line synchronization signal as a clock signal, and delays said frame synchronization signal by a predetermined number of pulses of said line synchronization signal.

4. The matrix-type display device of claim 1, wherein said display panel is a liquid-crystal display panel.

5. The matrix-type display device of claim 4, wherein said liquid-crystal display panel is of a reflective type, enabling the display content to be seen by reflection of externally incident light.

6. The matrix-type display device of claim 4, wherein said liquid-crystal display panel is of a reflective semi-transmissive type, enabling display content to be seen by reflection of externally incident light and by transmitted light.

7. The matrix-type display device of claim 4, wherein said liquid-crystal display panel is of an active-matrix type.

8. The matrix-type display device of claim 4, wherein said liquid-crystal display panel is of a fast-response super-twisted birefringent type.

9. The matrix-type display device of claim 1, wherein said display panel is an organic electroluminescent panel.

10. The matrix-type display device of claim 9, wherein said organic electroluminescent panel is of an active-matrix type.

* * * * *